United States Patent [19]

Lochte et al.

[11] 4,258,786

[45] Mar. 31, 1981

[54] SAFETY VALVE OPERATING APPARATUS

[75] Inventors: Glen E. Lochte, Houston; Lionel J. Milberger, Spring, both of Tex.

[73] Assignee: FMC Corporation, San Jose, Calif.

[21] Appl. No.: 32,973

[22] Filed: Apr. 24, 1979

Related U.S. Application Data

[63] Continuation-in-part of Ser. No. 912,275, Jun. 5, 1978, Pat. No. 4,193,449.

[51] Int. Cl.[3] ..... F16K 11/06; E21B 43/00

[52] U.S. Cl. ..... 166/72; 137/625.18; 166/321; 251/174

[58] Field of Search ..... 166/72, 321; 137/625.18, 625.48, 625.25, 625.21; 251/174, 297, 319

[56] References Cited

U.S. PATENT DOCUMENTS

| | | | |
|---|---|---|---|
| 2,998,070 | 8/1961 | Tamplen et al. | 166/72 |
| 3,078,923 | 2/1963 | Tausch | 166/72 |
| 3,375,874 | 4/1968 | Cherry et al. | 166/321 |
| 3,763,891 | 10/1973 | Stiltuer | 137/625.18 |
| 4,082,147 | 4/1978 | Wolff et al. | 166/323 |

*Primary Examiner*—James A. Leppink

*Attorney, Agent, or Firm*—W. W. Ritt, Jr.; Lloyd B. Guernsey

[57] ABSTRACT

A hydraulic valve operating circuit for providing positive opening and closing of a downhole safety valve includes shut-off valves which prevent leakage of fuel to the outside environment if a leak should occur in the hydraulic lines which are connected to the hydraulic actuator of the downhole safety valve. A hydraulic control line is connected to the actuator of the safety valve through a normally-closed shut-off valve and the hydraulic control line is also connected to the actuator of the shut-off valve to hold both the shut-off valve and the downhole safety valve open when the hydraulic line is pressurized. Another valve moves to a position to direct the flow of fluid from the safety valve to an accumulator when the pressure in the control line falls below a predetermined value to insure that the downhole safety valve will close properly. The accumulator and the actuator control valves can be replaced by a single gate valve having a novel porting arrangement as shown in one embodiment of the present invention. The gate valve can be adapted for use with either a balanced or a nonbalanced downhole safety valve.

11 Claims, 12 Drawing Figures

FIG_2
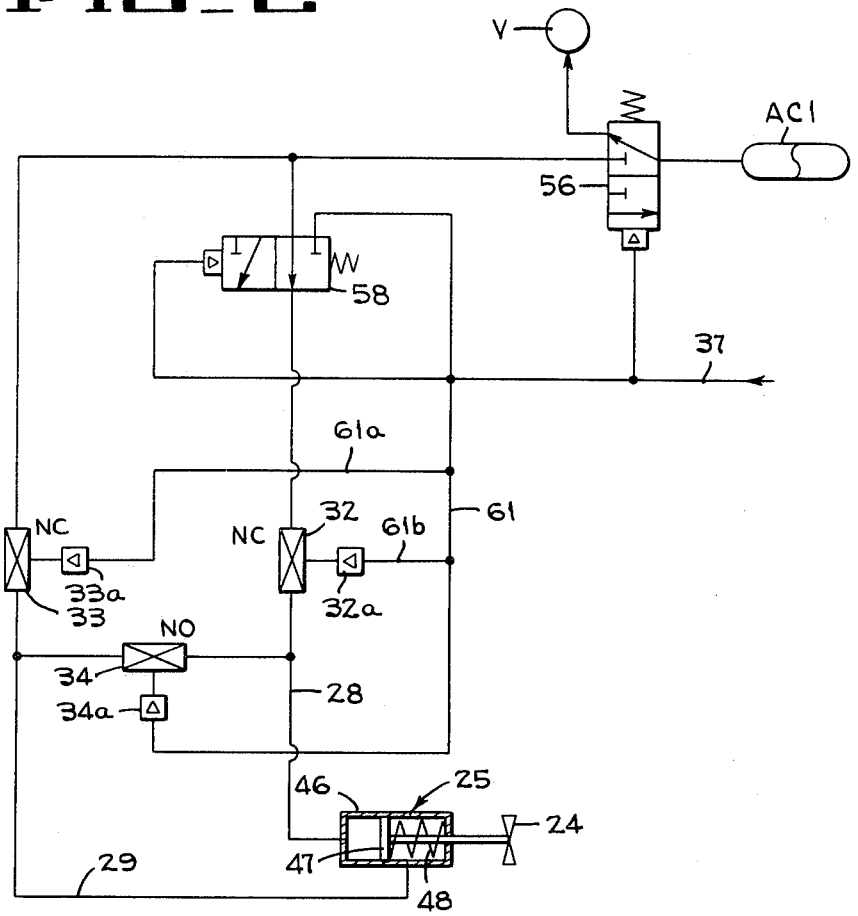
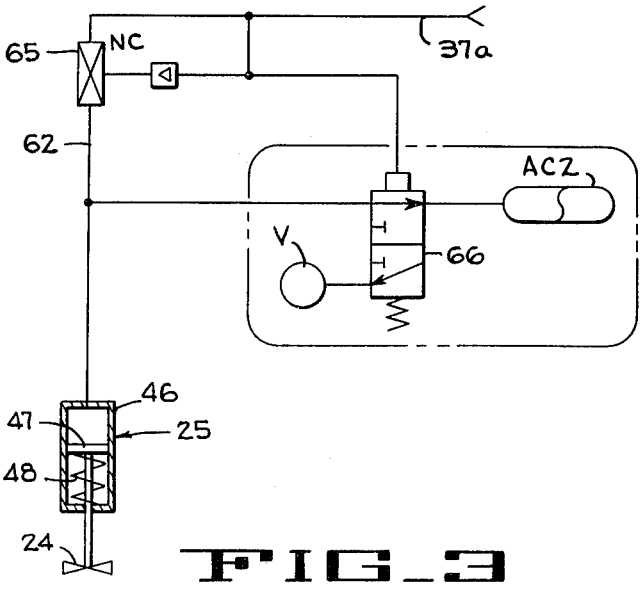
FIG_3
FIG_4
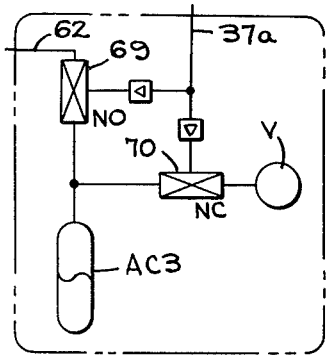

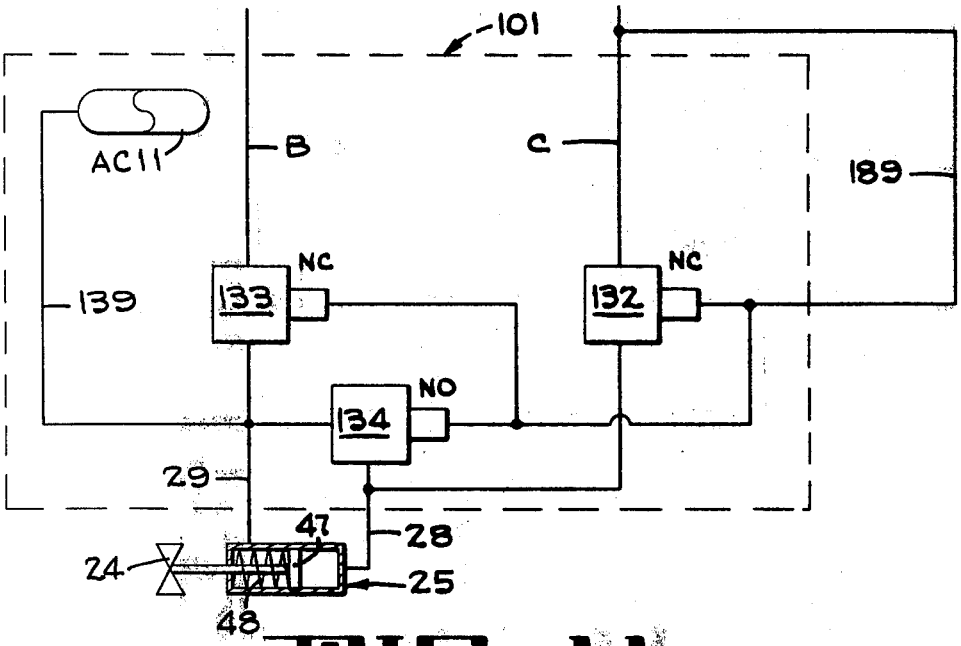
FIG_11
FIG_12
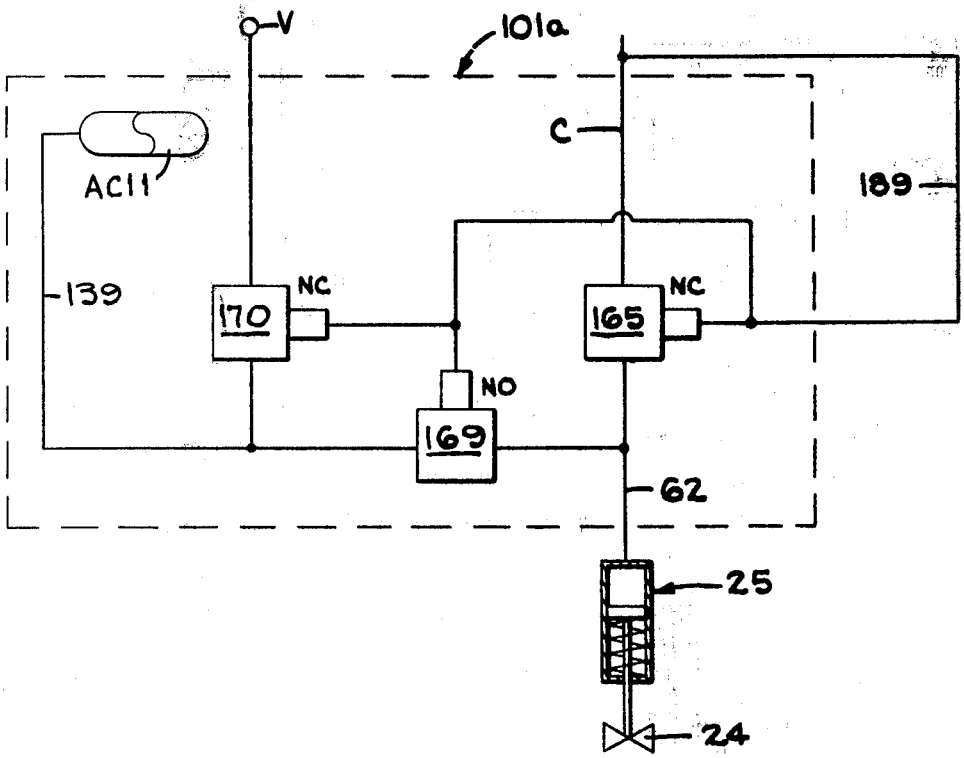

SAFETY VALVE OPERATING APPARATUS

This is a continuation-in-part of applicants' copending application Ser. No. 912,275, filed June 5, 1978, now U.S. Pat. No. 4,193,449.

BACKGROUND OF THE INVENTION

1. Field of the Invention

This invention relates to hydraulic valve control circuits, and more particularly to valve operating circuits for providing positive opening and closing of downhole safety valves while preventing leakage of fuel to the outside environment.

2. Description of the Prior Art

Crude oil and gas wells are often drilled and tubing is installed at locations where the internal pressure of the petroleum deposit is quite high so that precautions must be taken to prevent a blowout of the well. Such blowouts are not only costly in terms of loss of oil or gas but in addition a blowout is highly dangerous and the cost of controlling a blowout at an oil or gas well is rather high. As a result, many devices including safety valves and associated control circuits have been developed and many such devices have been installed in association with gas and oil wells. One such device which is frequently employed is a surface-controlled, sub-surface, safety valve (SCSSV) otherwise known as a downhole safety valve (DHSV) which may be installed within the tubing of a well either at the time the tubing is installed or alternatively such a valve can be installed from the surface using well-known wire line techniques. Such valves are generally installed 200 or 300 feet below the wellhead and are always of the "fail-close" design. The construction of these valves resembles a conventional ball valve and positive actuation against a spring is required to open a valve, for example, by applying hydraulic pressure to a small diameter control line and to a valve actuator which can be conveniently located within the well. In some of the installations the valve actuator can be positioned outside the tubing.

The controlling hydraulic pressure applied to the control line must be sufficient to develop a force on one face of the piston of the actuator which is greater than the combination of the opposing force developed by gas or oil pressure in the tubing acting on the opposite face of the piston and by the spring-generated valve closing force. Because of the depth of the safety valves there is a substantial fluid head in the control line which provides a substantial amount of tubing pressure acting on the piston of the actuator, so that the spring force and the valve depth and the location of the safety valve must be carefully selected to ensure complete closure of the valve when the pressure in the control line is relieved by action taken at the surface.

Another type of SCSSV hydraulic circuit in common use involves a hydraulic balance and requires both a hydraulic control line to open and close the valve and a balance line which communicates with the opposing face of the piston of the actuator. By means of this arrangement, the control line pressure needs only to overcome the spring force since otherwise the forces are equal but opposite as developed by the head in both the control line and in the balance line.

Whether a balanced type SCSSV or a non-balanced type is used, it is common practice to pass the control and/or balance lines through the wellhead and its connector and then exit the christmas tree below the master valve. The control and/or balance lines, after leaving the christmas tree, are connected to a control system to enable operation of the SCSSV.

The previously proposed control systems have the disadvantage that if a malfunction such as a leak occurs in the DHSV, which results in connecting the tubing bore to the control line, a high pressure leakage path is then formed to the outside environment. Such a leak can damage the control system and also allow oil or gas to pollute the environment. This problem has already been appreciated and with a view to solving it, shut-off valves have been provided where the control and/or balance lines leave the christmas tree. By this provision, if a leak should occur, the shut-off valves can be closed manually but further problems arise if the christmas tree is installed below the surface of the sea because the shut-off valves will then require actuators, for example, hydraulic actuators so that the shut-off valves can be remotely opened or closed.

It will be apparent that the shut-off valves in the control and/or balance lines must be open when it is desired to open the associated DHSV or SCSSV so that fluid can be forced under pressure to the actuating cylinder of the DHSV or SCSSV. Even more important, the shut-off valves must remain open until the DHSV or SCSSV has completely closed. Once the latter has closed it is desirable to close fully the shut-off valves. However, if the shut-off valves are allowed to close before the DHSV or SCSSV has completely closed, the shut-off valves will not allow fluid to flow away from the actuator of the DHSV or SCSSV, and therefore the latter will remain open or partially open. It follows that for fully safe operation there must be proper co-operation between the actuator of the DHSV or SCSSV and the shut-off valves particularly for remote or sub-sea surface locations. In order more fully to take into account the difficulties outlined above, control systems such as hydraulic sequencing or electro-hydraulic multiplexing systems have been proposed so that the shut-off valves are connected to separate hydraulic output lines of the control system and are actuated independently of the DHSV or SCSSV control line. These proposed control systems are generally satisfactory but do not provide for the sudden loss of hydraulic pressure in the control system. Such loss in hydraulic pressure will result in the well becoming shut down because all the valves from the christmas tree including the DHSV or SCSSV will close because of their "fail-close" characteristics. However, the loss of hydraulic pressure will provide no assurance that the shut-off valves will remain open long enough to allow complete closure of the associated DHSV or SCSSV.

As an alternative to the complexities of hydraulic sequencing or electro-hydraulic multiplexing, a simple hydraulic time delay circuit has been proposed which comprises simply a restrictor valve and an accumulator which ensures that the DHSV or SCSSV closes before the shut-off valve is timed to close. This system has the merit of simplicity but does not provide a complete answer to the problems involved. In particular it is neither possible readily to know the exact closing time of the DHSV after installation nor is it possible to ensure that it will remain constant over long periods of time. To ensure that the system is basically safe, it has been proposed simply to make the time constant long enough to accommodate the longest possible closing times for the DHSV or SCSSV. However, such long time constants require either very small orifice restrictor valves which are liable to clog or large accumulators which cannot readily be accommodated in the limited space available.

SUMMARY OF THE INVENTION

The present invention for providing positive opening and closing of a downhole safety valve includes a plurality of shut-off valves mounted in the walls of the well to connect the safety valve actuator to an outside hydraulic pressure source and to a pressure sink while isolating the safety valve from the outside environment. The shut-off valves prevent leakage of the petroleum to the outside environment if a leak should occur between the inside of the well and the hydraulic lines which are connected to the safety valve actuator. The shut-off valves also insure that the safety valve will close properly by relieving the fluid pressure applied to the safety valve actuator when it is desired to close the safety valve.

A hydraulic circuit according to the present invention comprises a fail-close safety valve, shut-off valve means in control piping of the safety valve operative to close on a drop in pressure in the control piping below a predetermined value, a safety valve actuator connected to the control piping and means operative on drop on pressure in the control piping to relieve pressure in the safety valve actuator whereby the safety valve and the shut-off valve means can close.

Further according to the present invention there is provided a control circuit for a fail-close surface-controlled, sub-surface, safety valve or a fail-close downhole safety valve comprising an actuator for the safety valve, a shut-off valve in a circuit connected to the safety valve and means responsive to a drop in pressure in the control circuit below a predetermined value to relieve pressure in the actuator of the safety valve and thus allow the safety valve and the shut-off valve to close.

Still further according to the present invention there is provided a hydraulic circuit comprising a downhole, fail-close safety valve, an actuator positively operable to open the safety valve, a control line of the circuit communicating through one normally-closed, shut-off valve with one face of the actuator piston, a balance line of the circuit communicating with the other face of the actuator piston through a second normally-closed shut-off valve, a control function line of the circuit communicating with actuators of the shut-off valves to hold the valves open when pressurized and a normally open shut-off valve providing communication between the two faces of the safety valve actuator whereby on reduction of pressure in the control function line the latter shut-off valve opens, the normally-closed shut-off valves close and the safety valve is free to close by virtue of its fail-close characteristic.

Yet further according to the present invention there is provided a hydraulic circuit comprising a downhole, fail-close, safety valve for incorporation in an oil or gas well, an actuator positively operable to open the safety valve, a control line of the circuit communicating with the actuator of the safety valve through a normally-closed shut-off valve, a control function line of the circuit connected to an actuator of the shut-off valve to hold the latter and the safety valve open when pressurized, an accumulator, and a valve movable to a position in which flow can take place from the safety valve actuator to the accumulator when pressure in the control function line falls below a predetermined value whereby the fail-close characteristics of the safety valve can be asserted.

BRIEF DESCRIPTION OF THE DRAWINGS

FIG. 2 is a circuit diagram of one embodiment of the present invention.

FIGS. 3 and 4 illustrate other embodiments of the present invention.

FIG. 11 is a circuit diagram of the embodiment of the gate valve of FIGS. 7 and 8 of the present invention.

FIG. 12 is a circuit diagram of the embodiment of the gate valve of FIGS. 9 and 10 of the present invention.

DESCRIPTION OF THE PREFERRED EMBODIMENT

Figure 1:
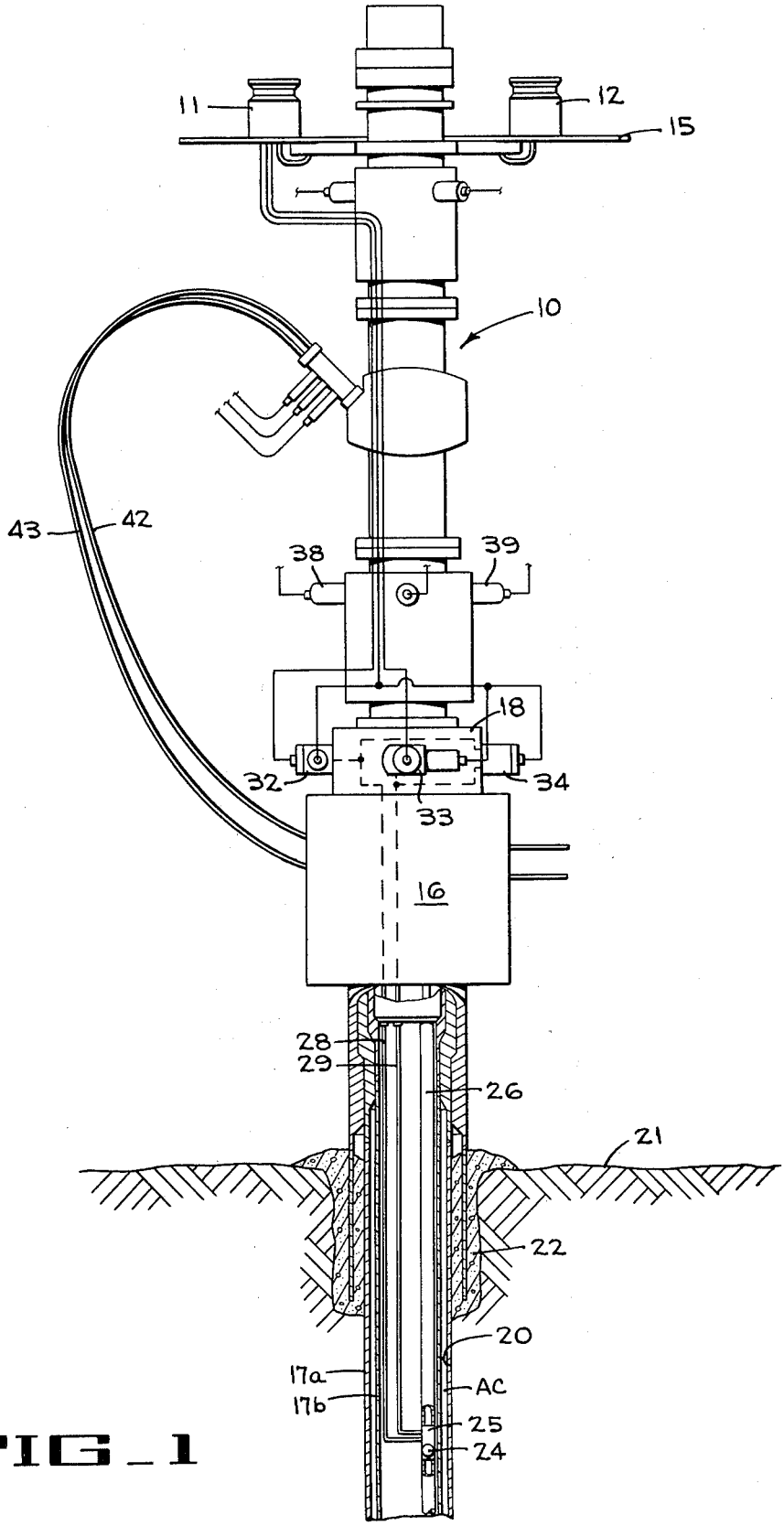
FIG. 1 is a diagrammatic side elevation of a subsea well in which the present invention may be used, with portions being broken away.

Referring now to the drawings, FIG. 1 discloses a petroleum well of the type that is used to produce oil and gas and includes a christmas tree 10 and a pair of control modules 11,12 mounted on a mounting plate 15. The christmas tree 10 is mounted atop the well by a tree connector 16, and a plurality of casing strings **17*a*,17*b* are suspended into a bore hole 20 drilled into a portion of the sea floor 21. The casing strings 17*a*,17*b* are anchored in position by cement 22 which is pumped into the annulus between the bore hole 20** and the outermost string of casing.

A downhole safety valve 24 and a downhole safety valve actuator 25 are mounted inside the inner string **17*b* several feet below the christmas tree 10 to provide positive control of fluid through a tubing string 26. The downhole safety valve actuator 25 is coupled to a hydraulic fluid pressure source and to a sink (not shown) in FIG. 1 by a pair of hydraulic lines 28,29 and by a plurality of shut-off valves or block valves 32-34 mounted in the wall of the christmas tree 10. The block valves 32-34 can be connected to a remote source of hydraulic fluid under pressure by a hydraulic line 37. A pair of valve operators 38,39 (FIG. 1) control the operation of a pair of christmas tree valves (not shown) inside the christmas tree to control the flow of oil from the christmas tree through a pair of flow lines 42,43 which are connected to the christmas tree. The flowlines are each in the form of a loop having sufficient radius so that conventional "through-flow-loop" tools (not shown) can pass through the flow lines. Operation of the valve operators 38,39 is controlled by the control modules 11,12**.

A circuit which provides control of a balance type downhole safety valve 24 (FIG. 2) includes the safety valve actuator 25 having an annular body 46 with a piston 47 mounted therein. The piston 47 is biased toward the left end of the actuator by a spring 48 which closes the valve when the piston is adjacent the left end of the body 46. The hydraulic control line 28 provides hydraulic fluid under pressure to move the piston 47 toward the right thereby opening the downhole safety valve 24, while the balance line 29 provides a fluid inlet to the right end of the annular body 46.

One face of the piston 47 of the actuator 25 is subjected to the pressure of the control line 28 (FIG. 2) through a normally-closed, shut-off valve 32 and the other face of the piston 47 is subjected to the pressure in the balance line 29 through the normally-closed, shut-off valve 33. The balance line 29 can be connected to an accumulator AC1 through a valve 56 when the latter is subjected to pressure in the control function line 37. Under this condition, a valve 58 provides communication between the control line 28 and a line 61 which is also permanently connected to the control function line 37. Under nonpressurized conditions the valves 56 and 58 assume the positions shown, with the accumulator AC1 dumping liquid to the sink V and valve 58 providing a communication between the balance and the control lines 29,28. The accumulator AC1 may be an enclosed tank which is connected to the valve 56 or an annular chamber AC between the casing strings 17*a*,17*b* (FIG. 1) may be used to store the hydraulic fluid. The system is preferably vented to sea with liquid from the sink V being discharged directly into the sea. In a vent-to-sea hydraulic system the hydraulic fluid contains a large percentage of water, for example, it may be 95% water. This results in a hydraulic fluid having a specific gravity of approximately 1 so that a pressure balance is achieved at the outlet of the subsea valve.

The shut-off valves 32 and 33 are normally closed and the shut-off valve 34 is normally open thereby connecting the control line 28 and the balance line 29 at a location in the circuit between the shut-off valves 32 and 33 and allowing the piston 47 of the actuator 25 to move toward the left as shown in FIG. 2. The actuator 34*a* of the valve 34 is connected to the control function line 37 by the line 61 which has branches 61*a*,61*b* connected to the actuators 33*a*,32*a* of the shut-off valves 33 and 32. It will be apparent that when the single control function line 37 is unpressurized, the valves 32 and 33 will be closed, the valve 34 will be open and under this condition the DHSV 24 should also move to its closed position. The low pressure on line 61 allows the valve 34 to open thereby providing a circulation path for the fluid in the DHSV actuator 25 so that fluid can be displaced from one face of the actuator piston 47 to the other and thus DHSV 24 is free to move to its closed position under the action of the spring 48.

The valves 32, 33 and 34 are physically located in a christmas tree adaptor 18 (FIG. 1) positioned above the wellhead connector 16 and below the valve operators 38 and 39. The porting and connection between the valves 32, 33 and 34 may be provided by cross-drilling in the tree adaptor 18 or tubing may be mounted outside the adaptor and connected between the various block valves.

Another embodiment of the present invention as shown in FIG. 3 incorporates a DHSV which is of the nonbalancing type and is operated by a single control line 62. A single SCSSV control function line 37*a* is connected to the control line 62 of the DHSV through a shutoff valve 65 which is normally closed. The control function line 37*a* is also connected to a valve 66 which, in the non-pressurized condition illustrated in FIG. 3 provides a direct connection from the control line 62 to an accumulator AC2. When the single control function line 37*a* is unpressurized, the valve 65 is closed and the valve 66 is in its normal, unenergized position as shown in FIG. 3. If the valve 65 were to close prior to the complete closing of the DHSV 25, the remaining fluid in the space above the piston 47 of the actuator 25 will be displaced into the accumulator AC2 through valve 66 thereby allowing the actuator to close the safety valve 24. Upon repressurization of the single control function line 37*a* the valve 66 shifts to block the control line 62 and dumps the fluid from the accumulator AC2 to the sink V.

The valve 66 is a commonly used 3-way valve which can be replaced by a pair of 2-way valves as shown in the embodiment of FIG. 4. In this embodiment the valve 66 is replaced by a normally-opened valve 69 and a normally-closed valve 70. When the single function control line 37*a* is unpressurized the valve 69 is in its normal open position so that the accumulator AC3 is connected to line 62 and the remaining fluid from the actuator 25 is stored in the accumulator AC3. Upon repressurizing of the single control function line 37*a* the valve 69 is closed and valve 70 is open so that the fluid stored in the accumulator AC3 will be dumped through the valve 70 to the sink V. Advantage of the circuit of FIG. 4 is that the same set of block valves which were shown in FIGS. 1 and 2 can be used to perform in the circuit shown in FIG. 4. One valve which can be used for each of the valves 32-34 and for valves 65,69 and 70 is a one inch slide gate valve with a hydraulic actuator, Model 40, manufactured by the FMC Corporation, Houston, Tex.

It is believed that the hereinbefore described hydraulic circuits will insure proper cooperation of the DHSV or the SCSSV and the shut-off valves whether operating in an oil or a gas well. Some of the advantages of the circuit shown in the present invention are as follows: (1) Only one control function line is needed to operate the DHSV and the shut-off valves; (2) The circuit can be adapted to both balanced and nonbalanced DHSVs; (3) The circuit is very simple and no substantial further complication is involved beyond the provision of the well known shut-off valves; (4) A small number of additional components is required; and (5) The DHSV remains free to displace hydraulic fluid so that it can close properly while the hydraulic passage through the wellhead is blocked off by a metal seat gate valve.

A single gate valve 101 of the present invention, as shown in FIGS. 5-8, can be used to perform the functions of the valve operating circuit of FIG. 2, including the functions of the accumulator AC1 and the block valves 32, 33 and 34. In some installations it may be desirable to include the accumulator as part of the interior portion of the well rather than include it in the gate valve. The gate valve 101 includes a base 102 having a pair of flanges 102*a* (FIG. 5) with a plurality of capscrews 103 therethrough for securing the gate valve to the christmas tree adaptor 18. A pair of fluid flow passages 105,106 (FIGS. 7,8) extend transversely through the base, and a gate chamber 107 extends through a portion of the base at right angles to and intersecting the passages 105 and 106, with each of the passages 105,106 including a pair of enlarged portions 105*a*,105*b*,106*a*,106*b* adjacent the chamber 107. Fitted into the enlarged portion of each of the passages is a hollow cylindrical insert 110-113, each insert having an annular groove 116 in an outer wall 117 and with an annular sealing member 118 mounted in the groove to provide a fluid-tight seal between the insert and the enlarged portion of the passage. Each of the inserts extends into the gate chamber 107 where it makes sliding contact with a flat valve gate 121 having a pair of ports 122,123 (FIGS. 6–8) therethrough.

The gate 121 (FIG. 6) includes a plurality of flat sections 121*a*-121*c* having the ports 122,123 formed through the small dimension of the sections and having a passageway 126 formed along the length of the gate with vertical inlets 126*a*,126*b* in the bottom of the gate at either end of the passageway 126. The sections 121*a*-121*c* can be welded or otherwise connected together after the passageway 126 is formed. When the valve gate 121 is moved into the energized position shown in FIG. 7 the ports 122,123 are aligned with the passages 105,106 respectively to allow fluid to move through the length of these passages.

Figure 7:
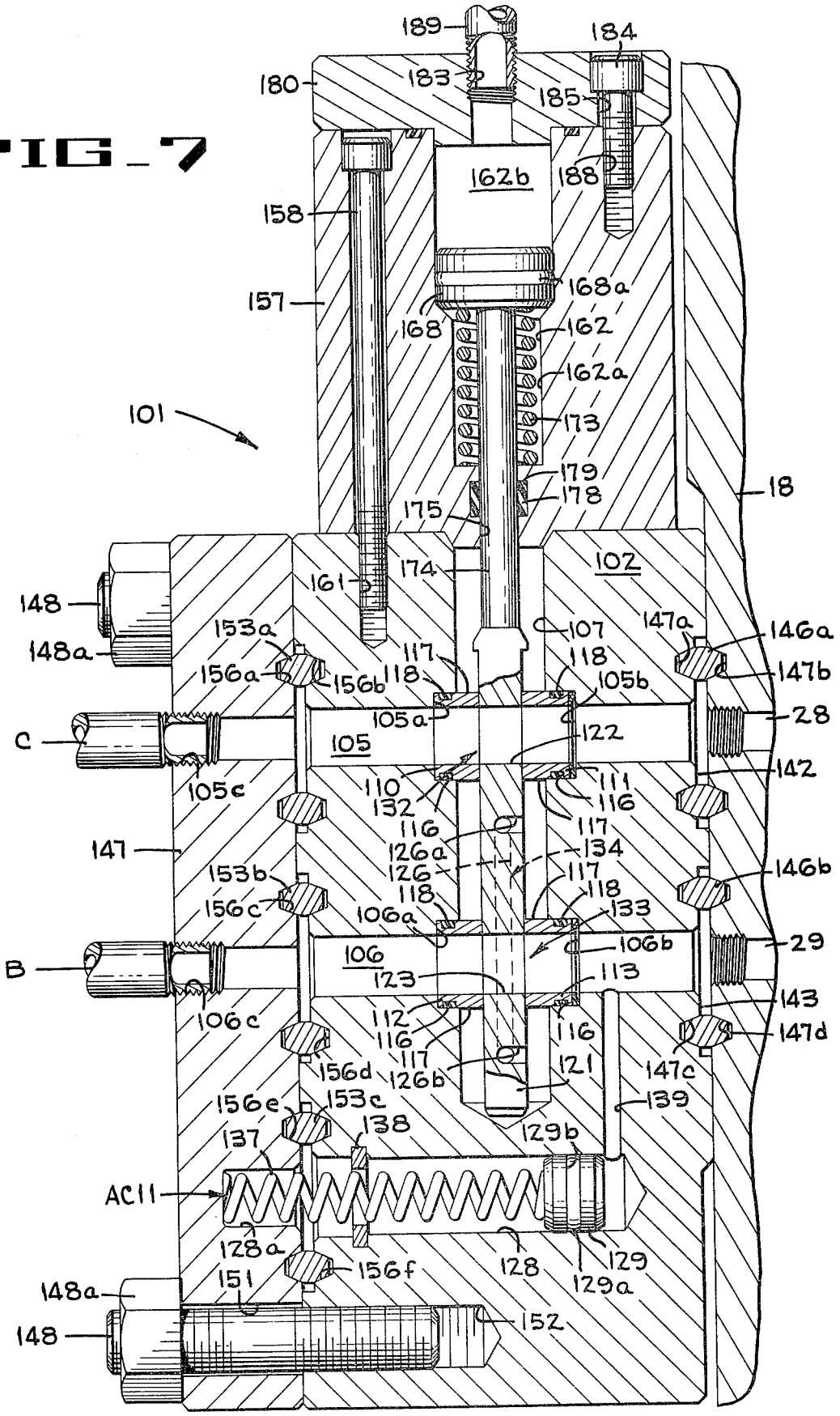
FIG. 7 is a vertical section of one embodiment of the gate valve of FIG. 5 taken along the line 7—7 of FIG. 5 with the valve in an energized position.
Figure 8:
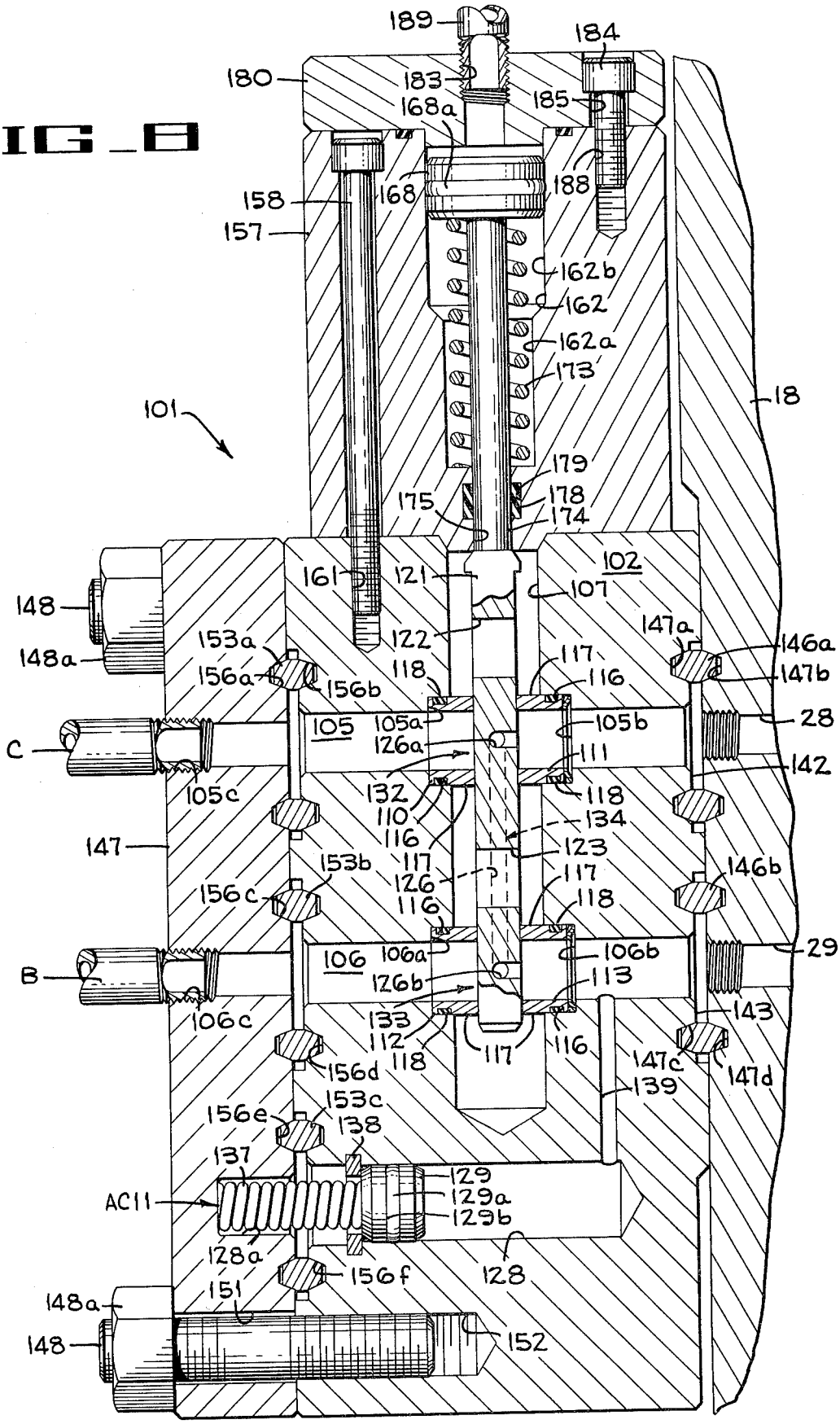
FIG. 8 is like FIG. 7, but with the valve in a deenergized position.

When the valve gate 121 is moved into the deenergized position shown in FIG. 8 the passageway 126 (FIGS. 6–8) in the valve gate 121 interconnects the right end portions of the passages 105, 106 and the valve gate 121 blocks the flow of fluid between the right and left portions of the passage 105 and between the right and left portions of the passage 106.

The lower portion of the base includes a fluid accumulator AC11 (FIGS. 7,8) comprising a chamber 128 having a movable piston 129 biased toward the right end of the chamber by a spring 137. A stop member 138 limits the travel of the piston 129 from the right end of the chamber 128. An annular sealing member 129*a* mounted in an annular groove 129*b* in the piston provides a fluid-tight seal between the piston 129 and the walls of the chamber 128. Fluid from the passage 106 is coupled to the chamber 128 by a passage 139 connected between the right end of chamber 128 and the passage 106.

Figure 5:
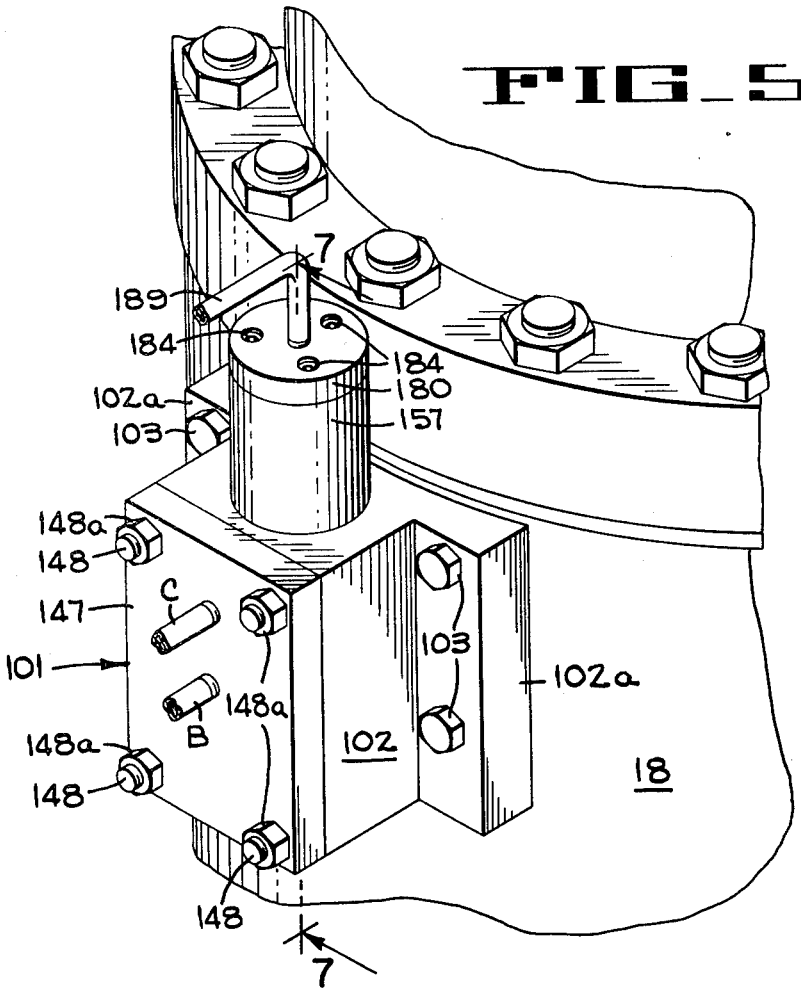
FIG. 5 is an enlarged isometric drawing of a portion of the subsea well of FIG. 1 showing a gate valve of the present invention mounted on the outside wall of the well.
Figure 6:
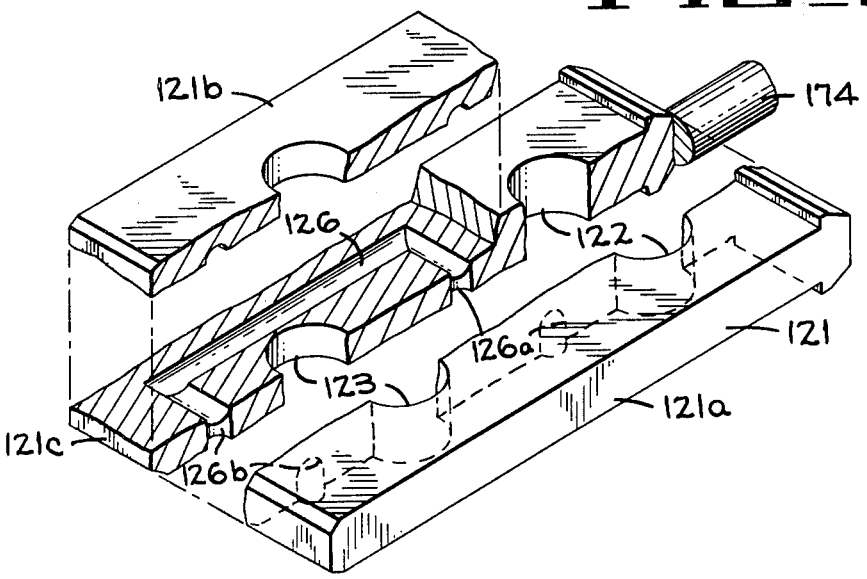
FIG. 6 is a fragmentary section of a valve gate of the gate valve of FIG. 5.
Figure 9:
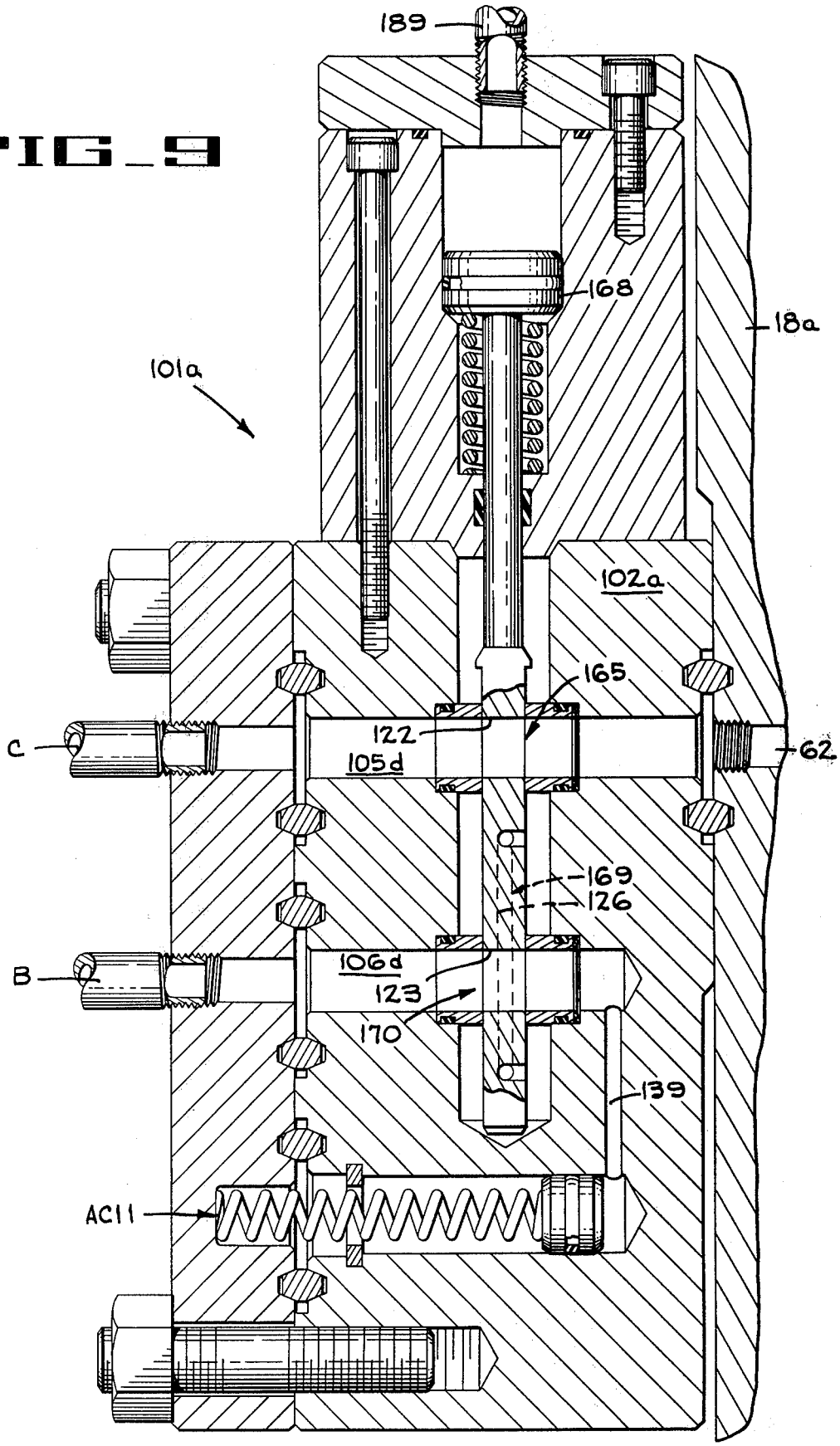
FIG. 9 is a vertical section similar to FIG. 7, of another embodiment of the present invention with the valve in an energized position.

The base 102 of the gate valve can be fastened to the christmas tree adaptor 18 (FIGS. 5,6) by the capscrews 103 as shown in FIG. 5 or by other suitable means, or the base may be formed as part of the wall of the christmas tree adaptor. The entire valve also can be machined into a portion of the tree adaptor. A pair of annular metal seals 146*a*,146*b* are mounted in a plurality of grooves 147*a*-147*d*, as shown in FIGS. 7 and 9, to provide fluid-tight seals between the base 102 and the christmas tree adaptor 18. Annular recessed areas 142,143 surrounding the right end of each of the passages 105,106 can each accommodate a flat sealing gasket (not shown) if this type of seal is preferred.

A cover plate 147 (FIGS. 7,8) is attached to the left end of the valve base 102 by a plurality of studs 148 each of which projects through a hole 151 in the cover plate 147 and is turned into a threaded bore 152 in the base 102. A nut 148*a* at the end of each stud secures the cover plate in position. A balance line B and a control function line C are connected to the left end of a pair of threaded bores 105*c*,106*c* respectively in the cover plate 147 and a pair of metal seals 153*a*,153*b* mounted in a plurality of annular grooves 156*a*-156*d* provide fluid-tight seals surrounding the passages 105,106 between the cover plate 147 and the base 102. A metal seal 153*c* mounted in a pair of annular grooves 156*e*,156*f* provide a fluid-tight seal between the portion of the base 102 surrounding the left end of the accumulator chamber 128 and portion of the cover plate 147 surrounding a smaller portion 128*a* of the chamber of the accumulator AC11.

A gate valve actuator 157 (FIGS. 5,7,8) is attached to the top of the base 102 by a plurality of capscrews 158 (only one being shown) each of which is turned into a threaded bore 161 in the base 102. The actuator 157 includes a longitudinal bore 152 having a lower portion 162*a* and an enlarged upper portion 162*b*. A movable piston 168 having an annular sealing element 168*a* between the outside of the piston and the walls of the bore 162*b* is biased toward the upper end of the bore 162*b* by a spring 173. The piston 168 is connected to the valve gate 121 by a rod 174 mounted in a bore 175 in the lower portion of the actuator. An annular sealing element 178 in a groove 179 provides a seal between the rod 174 and the actuator 157.

A cap 180 (FIGS. 5,7,8), having a threaded bore 183 therethrough, is attached to the actuator 157 by a plurality of capscrews 184 each of which is mounted through a bore 185 and turned into a threaded bore 188 in the actuator 157. A hydraulic line 189 can be connected to a source of pressurized hydraulic fluid (not shown) to provide power to actuate the actuator 157.

When the christmas tree 10 and the gate valve 101 are mounted on a surface platform, the valve gate 121 can be moved from the energized to the deenergized position by a hand wheel actuator instead of the hydraulic actuator shown in FIG. 7.

The gate valve 101 of FIGS. 7 and 8 can be schematically represented by the equivalent hydraulic circuit shown inside the dotted lines of FIG. 11. The valve gate 121 (FIGS. 7,8) and the passages 105,106 provide the same functions as a normally open valve 134 (FIG. 11) and a pair of normally closed valves 132,133 with the passage 105 and port 122 providing the function of the valve 132. The passage 106 and port 123 provide the function of the valve 133, and the passageway 126 and passage 105,106 provide the same function as the valve 134 of FIG. 11.

In the deenergized position shown in FIG. 8 the passageway 126 in the valve gate 121 interconnects the hydraulic lines 28,29 (FIGS. 2,7,8) as does the normally open valve 134 of FIG. 11, and the valve gate 121 isolates the balance line B from the hydraulic line 29 and isolates the control function line C from the hydraulic line 28. When the hydraulic lines 28,29 are interconnected the piston 47 (FIG. 11) is forced to the right end of the actuator 25 by the spring 48 and fluid from the right end of the actuator 25 flows through the valve 134 to the left end of the actuator 25, thereby closing the downhole safety valve 24. Because of the space occupied by the spring 48 and because of other design requirements, the volume of fluid expelled from the right end of the actuator 25 may be slightly different than the fluid which flows into the left end of the actuator 25. The accumulator AC11 is connected to the line 29 at the left end of the actuator 25 to receive any excess fluid.

In a typical installation the inlet bore 183 (FIGS. 7,8) of the gate valve actuator 157 is connected to the control line C as shown in FIG. 11 and control line C is selectively connected to a source of pressurized fluid. When pressure is applied to the control function line C, the pressure forces piston 168 of the actuator 157 to move down into the energized position shown in FIG. 7 thereby aligning the port 122 of the valve gate 121 with the right and left portions of passage 105, and connecting the control function line C to the hydraulic line 28 as is done by energizing the normally closed valve 132 of FIG. 11. In the energized position of the valve 101 the port 123 of the valve gate 121 (FIG. 7) connects the hydraulic line 29 to the balance line B as is done by energizing the normally closed valve 133 of FIG. 11. The single actuator 157 (FIGS. 7,8) provides the same function as a plurality of actuators 132*a*-134*a* shown in FIG. 11 and as the actuators 32*a*-34*a* of FIG. 2.

Figure 10:
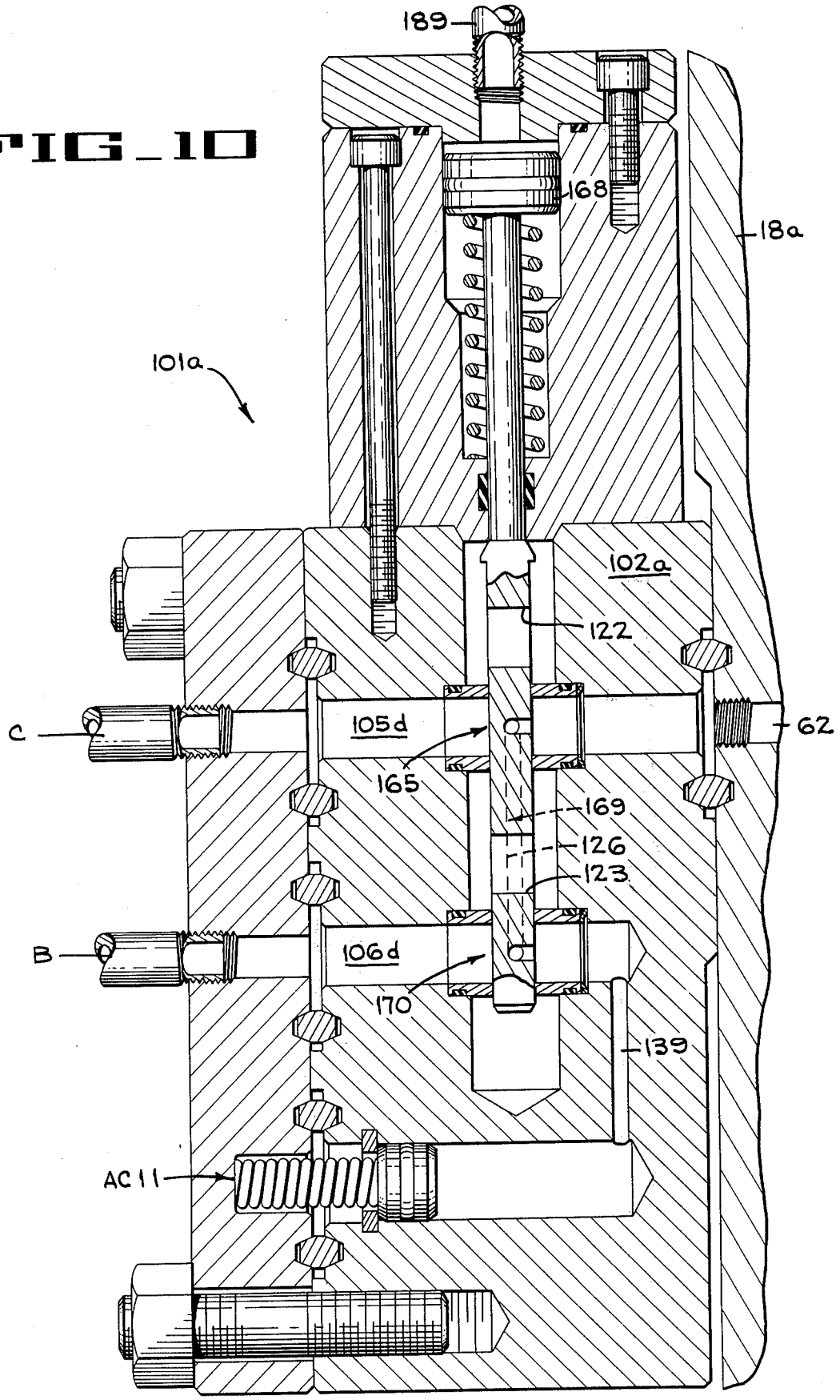
FIG. 10 is like FIG. 9, but with the valve in a deenergized position.

Another embodiment of the gate valve of the present invention as shown in FIGS. 9 and 10 is used with a DHSV of the non-balancing type shown in FIGS. 3 and 12, the non-balancing DHSV of FIG. 3 being described hereinbefore. A gate valve 101*a* (FIGS. 9,10) is similar to the gate valve 101 (FIGS. 7,8), except a passage 106*d* of valve 101*a* extends only a portion of the way through a base 102*a*. The parts of the gate valve 101*a* which are similar to the parts of gate valve 101 have been given similar part numbers and it should be understood that they operate in a similar fashion.

When hydraulic pressure is applied to the control function line C (FIGS. 9,12) the pressure on the hydraulic line 189 causes the piston 168 to move into the energized position shown in FIG. 9 to open a normally closed valve 165 and connect the line 62 of the christmas tree adaptor 18*a*, to the control function line C. The pressure on the line 62 energizes the downhole safety valve actuator 25 (FIG. 12) and opens the downhole safety valve 24. When the control function line C is unpressurized, the valve 165 is closed and the valve 169 (FIGS. 10,12) interconnects the hydraulic line 62 and the passage 106*d* via the passageway 126 (FIG. 10) allowing the hydraulic fluid to flow from the downhole safety valve actuator 25 into the accumulator AC11 via the passage 139. Upon repressurization of the control function line C the valve 170 opens to dump the fluid from the accumulator AC11 to the sink V (FIG. 12) via the port 123 (FIG. 9) and the passage 106*d*.

Some of the advantages of the gate valve of the present invention are as follows:

(1) Only one control function line is needed to both operate the DHSV and the gate valve;
(2) The gate valve can be adapted to control both balanced and nonbalanced DHSVs;
(3) The gate valve isolates the DHSV from the outside of the well; and
(4) The single gate valve performs the functions of three block valves.

Although the best mode contemplated for carrying out the present invention has been herein shown and described, it will be apparent that modification and variation may be made without departing from what is regarded to be the subject matter of the invention.

What is claimed is:

1. A hydraulic valve for use with a source of pressurized hydraulic fluid and a downhole safety valve mounted in a petroleum well, said safety valve including a safety valve actuator having an inlet port, said hydraulic valve comprising:

a valve base having first and second inlets and an outlet;
means for connecting said base outlet to said safety valve inlet port;
a fluid accumulator;
a valve gate having first and second ports and a passageway therethrough;
means for slidably mounting said valve gate in said valve base to connect said base outlet to said first base inlet through said first gate port and to connect said accumulator to said second base inlet through said second gate port when said valve gate is in a first position, said gate passageway interconnecting said accumulator and said gate outlet when said valve gate is in a second position; and
valve actuator means for selectively moving said valve gate between said first and second positions.

2. A hydraulic valve as defined in claim 1 wherein said fluid accumulator comprises a chamber in said valve base.

3. A hydraulic valve as defined in claim 1 wherein said fluid accumulator includes a chamber in said valve base having a piston slidably mounted therein, a spring means for biasing said piston toward one end of said chamber and an accumulator inlet at said one end of said chamber.

4. A hydraulic valve as defined in claim 1 including means for selectively energizing said valve actuator means, and means for connecting said first base inlet to a source of hydraulic pressure.

5. A hydraulic valve as defined in claim 1 including means for selectively connecting said valve actuator means and said first base inlet to a source of hydraulic pressure.

6. A hydraulic valve as defined in claim 5 including means for connecting said first base inlet to a vent.

7. A hydraulic valve for use with a source of pressurized hydraulic fluid and a downhole safety valve mounted in a petroleum well, said safety valve including a safety valve actuator having first and second inlet ports, said hydraulic valve comprising:

a valve base having first and second inlets, first and second outlets and a fluid accumulator chamber;
means for connecting said first base outlet to said first actuator inlet port;
means for connecting said second base outlet to said second actuator inlet port;
a valve gate having first and second ports and a passageway therethrough;
means for slidably mounting said valve gate in said valve base to connect said first base outlet to said first base inlet through said first gate port and to connect said second base outlet to said second base inlet through said second gate port when said valve gate is in a first position, said gate passageway interconnecting said first and said second base outlets when said valve gate is in a second position;
valve actuator means for selectively moving said valve gate to said first and said second positions; and
means for coupling said fluid accumulator chamber to said second base outlet.

8. A hydraulic valve as defined in claim 7 including a piston slidably mounted in said accumulator chamber, and a spring means for biasing said piston toward one end of said accumulator chamber.

9. A hydraulic valve as defined in claim 7 including a pair of hydraulic lines each connected between an inlet port in said petroleum well and a corresponding one of said safety valve actuator inlet ports, and means for connecting said first and said second base outlets directly to a corresponding one of said petroleum well ports to isolate said safety valve actuator from the outside of said well when said valve gate is in said second position.

10. A hydraulic valve as defined in claim 9 including means for biasing said valve gate toward said second position.

11. A hydraulic valve as defined in claim 9 including bias means for moving said valve gate into said second position when said valve actuator means is deenergized.

* * * * *